US012065920B2

(12) United States Patent
Patil et al.

(10) Patent No.: US 12,065,920 B2
(45) Date of Patent: Aug. 20, 2024

(54) COMPOSITION AND METHOD FOR NON-MECHANICAL INTERVENTION AND REMEDIATION OF WELLBORE DAMAGE AND RESERVOIR FRACTURES

(71) Applicant: Finoric, LLC, Beasley, TX (US)

(72) Inventors: Deepak Patil, Friendswood, TX (US); Ambrish Kamdar, Beasley, TX (US); Michael C. Lantz, Beasley, TX (US)

(73) Assignee: Kairos Energy Services Inc., Beasley, TX (US)

( * ) Notice: Subject to any disclaimer, the term of this patent is extended or adjusted under 35 U.S.C. 154(b) by 0 days.

(21) Appl. No.: 17/496,298

(22) Filed: Oct. 7, 2021

(65) Prior Publication Data

US 2022/0106864 A1 Apr. 7, 2022

Related U.S. Application Data

(60) Provisional application No. 63/088,755, filed on Oct. 7, 2020.

(51) Int. Cl.
*E21B 43/27* (2006.01)

(52) U.S. Cl.
CPC ..... *E21B 43/27* (2020.05)

(58) Field of Classification Search
None
See application file for complete search history.

(56) References Cited

U.S. PATENT DOCUMENTS

2010/0212906 A1* 8/2010 Fulton ..... C09K 8/62 166/308.5
2014/0182841 A1* 7/2014 Lecerf ..... E21B 43/26 166/250.01
2018/0306013 A1* 10/2018 Karale ..... E21B 33/122
2019/0016947 A1* 1/2019 Mahmoud ..... C09K 8/74

* cited by examiner

*Primary Examiner* — Anuradha Ahuja

(57) ABSTRACT

A method of non-mechanically remediating damage to a wellbore comprising a plurality of fracture stages is disclosed. A total treatment volume is calculated based on the plurality of fracture stages, the wellbore space, and either the production tubing or the annulus of the wellbore. The fracture stages of the wellbore are then divided into a plurality of chemical stages. The wellbore is pre-flushed, and each chemical stage is treated and isolated in order of depth by a volume of remediation chemicals and a volume of diverter. A post-treatment flush completes the remediation process and after a shut-in period, the well's production is substantially improved.

16 Claims, 8 Drawing Sheets

COMPOSITION AND METHOD FOR NON-MECHANICAL INTERVENTION AND REMEDIATION OF WELLBORE DAMAGE AND RESERVOIR FRACTURES

REFERENCE TO RELATED APPLICATIONS

This is a non-provisional application claiming priority to and benefit of U.S. Provisional Application No. 63/088,755, filed 7 Oct. 2020, having the same title and inventors. The contents of the above-referenced provisional are incorporated in their entirety.

FIELD

The invention is in the field of oil & gas production, specifically, non-mechanical interventions involving the hydraulic injection of chemicals into a wellbore to remediate damage and stimulate production of hydrocarbons.

BACKGROUND

It is common practice to treat subterranean formations to increase the permeability of shale formations identified generally as fracturing processes. Hydraulically fracturing these formations produces cracks or "fractures" in the surrounding formation by mechanical breakdown of the formation. Fracturing may be carried out in wells which are completed in subterranean formations for virtually any purpose. The usual candidates for fracturing, or other stimulation procedures, are production wells completed in oil and/or gas containing formations. However, injection wells used in secondary or tertiary recovery operations, for example, for the injection of water or gas, may also be fractured to facilitate the injection of fluids into such subterranean formations.

Hydraulic fracturing is accomplished by injecting a hydraulic fracturing fluid into the well under sufficient pressure to cause the formation to break down. Usually a gel, an emulsion or a foam is introduced into the fracture with a proppant such as sand. The proppant is deposited in the fracture and functions to hold the fracture open after the pressure is released and the fracturing fluid flows back into the well. The fracturing fluid has a sufficiently high viscosity to retain the proppant in suspension or at least to reduce the tendency of the proppant to settle out of the fracturing fluid as the fracturing fluid flows along the created fracture.

During the production phase, various types of chemicals are required to aid the production, handling, and transportation of crude oil. The chemicals used fall into several types as outlined below. For most, only trace amounts may remain in the crude as impurities once it reaches the refinery.

Most oilfield production chemicals are complex formulations of many different chemicals. Often the constituent chemicals themselves are not pure chemical species but a mixture of reaction products, reactants, and diluents. The formulation usually has one or two primary ingredients that give the additive its main functionality. In addition, the formulation is specifically designed for each oilfield, and within the oilfield, for each well, and for each well the recipe may vary depending upon the time and the operational conditions.

During the production phase, the flow of oil out of the well needs to be assured by preventing the deposition of hydrates, wax, asphaltenes, or scale. Chemicals provide a means for controlling such deposits. These chemicals are used in continuous low dose injection during the production phase to keep the well clean and permit flow of hydrocarbons and water.

Despite chemicals introduced during fracturing and production phases, damage to the well and formation occurs during both the completion and production phases. Damage to the flow of hydrocarbons can occur in the wellbore, near wellbore, reservoir fractures or on the formation face of subterranean formations which can severely reduce hydrocarbon production. Both organic and inorganic damage mechanisms can negatively affect hydrocarbon production.

The most likely organic damage is precipitation of the heaviest polarizable fraction asphaltenes and/or alkanes of carbon numbers 14-60, characterized as paraffin waxes. Inorganic damage can include precipitation of various types of scale that can generally occur from two different mechanisms: 1) self-scaling of the formation water due to changes in temperature, pressure or formation water due to reservoir depletion 2) incompatibility between an injected water and formation resulting in supersaturation and precipitation.

Further, formation fines migration and swelling (clay damage) can be caused by high injection fluid velocities and low injection fluid salinities. Clays can swell which can block pore throats or can become dislodged and subsequently block pore throats. Water phase trapping can occur at fracture-formation face where capillary forces are greater than drawdown forces, typically in low permeability reservoirs where capillary forces are high The above damage mechanisms could be present in any subterranean hydrocarbon formation; however, formations that require hydraulic fracturing utilizing proppant laden fluid for hydrocarbon production are subject to additional damage mechanisms specific to the propped and natural fractures. The productivity of propped fractures can be measured as fracture conductivity which is related to fracture permeability and the fracture geometry. Damage to fracture permeability will result in loss in conductivity and therefore hydrocarbon production.

These damage mechanisms include proppant embedment, which is stress-induced interaction between proppants and fracture surface can lead to proppant embedment and crushing resulting in generation of fine particles which can plug pore throats in the fracture; proppant crushing, or increases in stress on proppant can result in proppant crushing further generating fines which can plug pore throats in the fracture; completion fluid damage, primarily realized as reduction to fracture permeability due to incomplete break-up and flow back of the viscous fluid used to carry proppant; non-Darcy inertial flow, large fluid and/or gas velocities through the proppant pack resulting in significant energy loss and multi-phase flow; and multi-phase flow, resulting in inefficient flow regimes and reduction in the relative permeability of the desirable hydrocarbon phase.

The above damage mechanisms, within and near the wellbore, will restrict hydrocarbon production. Further, damage to the fracture conductivity can result in severe reductions in hydrocarbon production and it has been shown that fracture conductivity can be reduced by greater than 90% of the original or predicted fracture conductivity.

Well remediation of the above damage mechanisms comes in various forms. Introduction of acids such as hydrochloric and methanesulfonic acids are the most common acids to deal with the scale issue. Solvents and dispersants such as xylene and non-ionic surfactants have been used to dissolve and remove organic damage. There is no dearth of evidence for pumping various fluids containing surfactants during fracturing or production operations to enhance flow of oil and gas.

Various hot fluids and chemicals generating heat are used to disperse or dissolve these deposits. Above ground or subterranean heaters are used to increase the shale temperature to thin the fluids and permit flow through the fractures. The well may also be fractured again (e.g. re-fracturing) to open the existing fractures and/or create new fractures.

Generally, the introduction of chemistry for remedial purposes is either done through bullheading or fullbore injection (i.e. injection of fluid through production tubing, production casing, and/or the annular space without any attempt to isolate specific perforations or fracture stages) with no isolation of individual fracture stages or mechanical intervention is used to place the fluid in a specific are of the wellbore. The former method is typically focused on remediation of damage within the wellbore. Mechanical intervention can remediate within the wellbore, near wellbore, fractures, and fracture-formation interface. Rigs such as "fracturing rigs", temporary plugs, "coil tubing rigs", heaters for providing hot fluid, etc are used to perform these operations.

Given the time and expense involved in mechanical intervention, a need exists for a non-mechanical intervention multi-stage process that combines a chemical diverter with remediation chemicals to allow the chemistry to maximize contact with the wellbore, penetrate natural or previously hydraulically induced fractures, and contact the formation face. The process fluid volume is calculated based on the wellbore geometry and the pore volume of the propped fractures.

Embodiments described within the present disclosure meet these needs.

SUMMARY

A method is disclosed to inject chemistry into an existing well producing from a subterranean formation, in a non-mechanical intervention manner, designed to remediate damage in the wellbore, near wellbore, and the reservoir fractures to increase oil and gas production. In this process, non-mechanical intervention means without the use of a workover rig, through tubing flexible tubing, or other mechanical process that enters or alters the well. This process is a multi-stage approach that combines a chemical diverter with remediation chemicals to allow the chemistry to maximize contact with the wellbore, penetrate natural or previously hydraulically induced fractures, and contact the formation face.

Injection of fluids into a wellbore will exit the wellbore into the path of least resistance. The path of least resistance will be the highest permeability zone, a fracture with the highest conductivity, or during fracturing operations the lowest pressure zone. Chemical diverters are solids that temporarily block the path of least resistance and divert fluids to the next path of least resistance. In a preferred embodiment, the diverter will temporarily block the most conductive fracture and divert the remedial chemistry to the next highest conductive fracture. This process will continue to maximize entry of the remedial chemistry into all the existing fractures connected to the wellbore.

Where this method can be applied on vertical or horizontal wells with at least two hydraulically fractured stages. Completion of the well can be open or cased hole.

Detailed embodiments are described below with respect to one of the above-listed figures.

DETAILED DESCRIPTION

This can process can be applied in a subterranean formation that is a hydrocarbon or non-hydrocarbon bearing zone. For hydrocarbon bearing formations, it may be applied to oil, gas, condensate, or some combination thereof. The subterranean formation may be a carbonate formation such as limestone, chalk, or dolomite, or a sandstone or siliceous formation composed of quartz, clay, shale, chert, zeolite, or a combination thereof.

Figure 1:
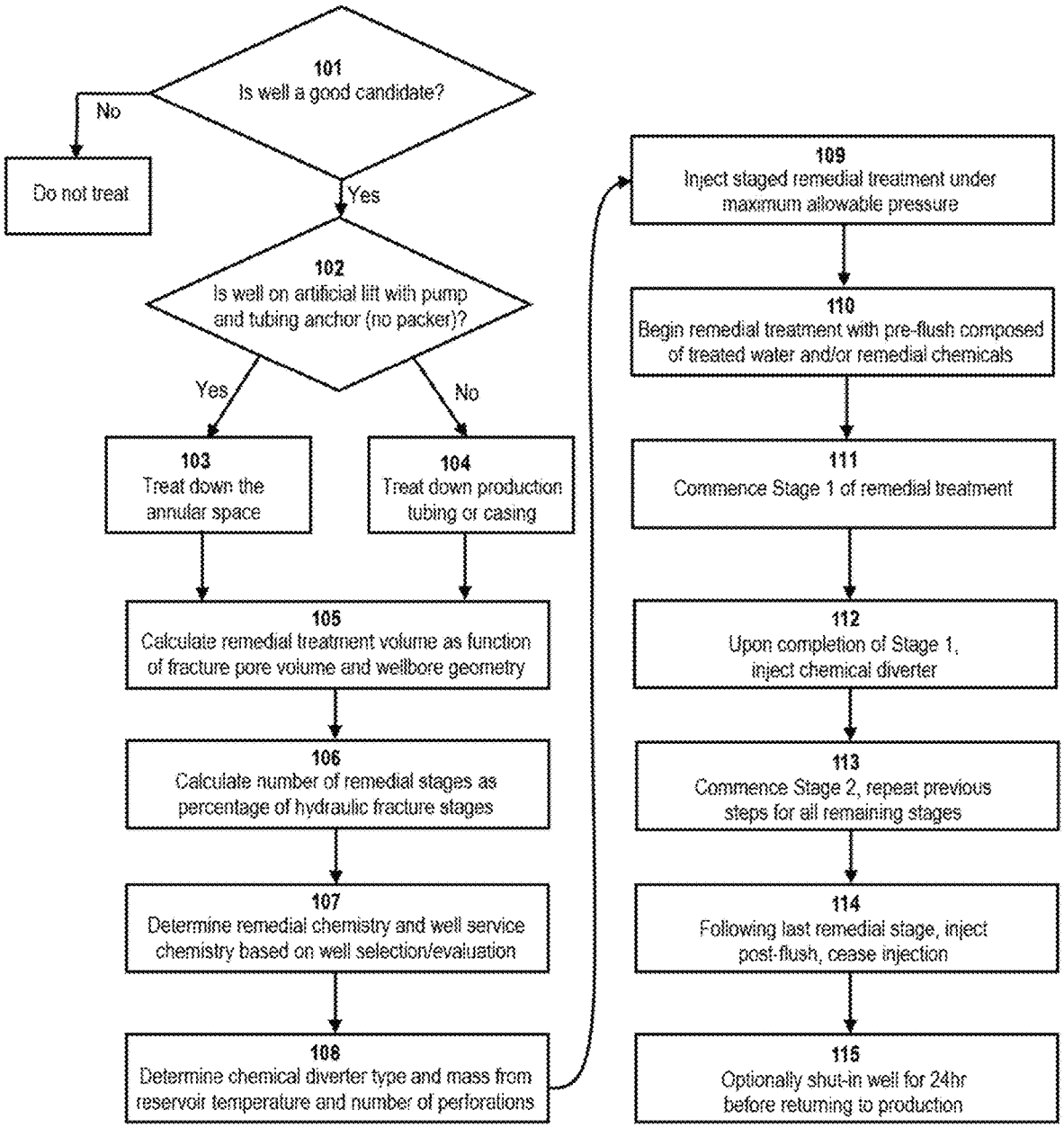
FIG. 1 depicts a flowchart of a method embodiment of a non-mechanical intervention remedial treatment.

Turning now to FIG. 1, a flowchart for the application of the remedial treatment without the use of mechanical intervention is shown. A well is evaluated to be a good candidate (101) through different production and reservoir engineering methods common in the art. Production methods may include but are not limited to field and laboratory observations of organic depositions, inorganic depositions, and poor artificial lift performance. Reservoir engineering methods may include but is not limited to well hydrocarbon performance versus type curve analysis, diagnostic plot analysis, rate transient analysis, and numerical simulation.

The injection process is carried out with no mechanical intervention into the existing well. The injection point of the process into the well will depend on if the well is on artificial lift and if so, what type of artificial lift. Artificial lift is defined as a process to increase pressure within the subterranean formation to increase hydrocarbon production. Dependent on the current well setup (102) the injection process can be through the annular space or down the production tubing or casing. Examples of when to treat down the annulus (103) are when the well is on rod lift and tubing is secured through tubing anchors. Examples of when to treat down the production tubing/casing (104) are when the well is flowing; rod pump artificial lifts where tubing is secured with packer and pump is unseated prior to injected;

wells on gas artificial lift; and wells electronic submersible pump artificial lift (where the treatment is injected through said pump).

The next step in the process is the calculation of the volume of the remedial treatment fluid required (105). The total treatment volume considers the tubing volume, wellbore volume, and the hydraulically fractured propped pore volume. The tubing and wellbore volume are calculated based on the geometry of each, respectively, and the specific application volume is based on the well's artificial lift method. The fracture pore volume is directly related to the mass of proppant placed during the original fracture completion treatment, the proppant type and mesh size of the proppant. Table 1 shows a general correlation for white sand proppant between mesh size, median proppant diameter and unstressed pack porosity. Unstressed porosity does not change significantly below a closure stress of 7,000 to 8,000 psi and clean sand proppant pack porosity can vary from approximately 26% to 47%.

TABLE 1

Correlations between mesh size and unstressed proppant pack porosity for white sand

| Mesh Size | Dmedian Proppant (microns) | Porosity (%) |
|---|---|---|
| 20/40 | 1550 | 39% |
| 30/50 | 450 | 38% |
| 40/70 | 290 | 37% |
| 70/140 | 173 | 36% |

The fracture pore volume for each fracture stage should be calculated based on the stage proppant mass pumped during the fracture completion where the fracture pore volume ($PV_{frac}$) is $$PV_{frac} = \frac{m_{sand}}{\rho_{sand}} * \frac{\phi_{sand}}{(1-\phi_{sand})}$$

and where $m_{sand}$=mass of proppant, $\rho_{sand}$=proppant bulk density, $\phi_{sand}$=proppant pack porosity. This process applies to any well with more than two hydraulic fracture stages.

A chemical stage is defined as a volume of fluid equal to the pore volume of frac stage(s) and composed of the remedial chemicals. The number of chemical stages can vary, as multiple frac stages may be treated in a single chemical stage (106). The number of chemical stages as a percentage of fracture stages will decrease as the number of fracture stages and/or perforations increase. Generally, the number of fracture stages a chemical stage will treat will increase as the treatment progresses. This is due to the highest conductivity fractures will take the majority of the fluid first and thus smaller chemical stage volumes and higher chemical diverter intensity is required.

The treatment fluid injected as part of the method includes chemistry to remediate multiple different damage mechanisms (107). The treatment fluid may include treated water and remediation chemicals. Treated water is defined as brine, which may include typical well service chemicals such as biocides, scale inhibitors, corrosion inhibitors, and oxygen scavengers. Suitable brines include chloride, bromide, formate, acetate, and other carboxylic acid, salts of potassium, sodium, cesium, ammonia, calcium, magnesium, zinc, or mixtures thereof. The percentage of salt in the water preferably ranges from about 0% to about 60% by weight.

Remedial chemicals are defined as chemicals which remediate damage in and immediately surrounding the wellbore, the proppant pack, natural un-propped fractures, and the formation-proppant pack interface. Remedial chemicals may include solvents, organic and inorganic acids and salts and esters thereof, acid, acid inhibitors, surfactants, mutual solvents, enzyme breakers, oxidizers, clay stabilizers, nanoparticles, or some combination thereof. Chemical diverters (108) are defined as particulate diverting agents that either dissolve in the produced fluids such as rock salt, benzoic acid, naphthalene, wax beads, oil soluble resin, or biodegradable diverters such as polyanhydrides, polyesters, polyorthoesters, polylactones, polyamides, and polyurethanes.

Figure 2A:
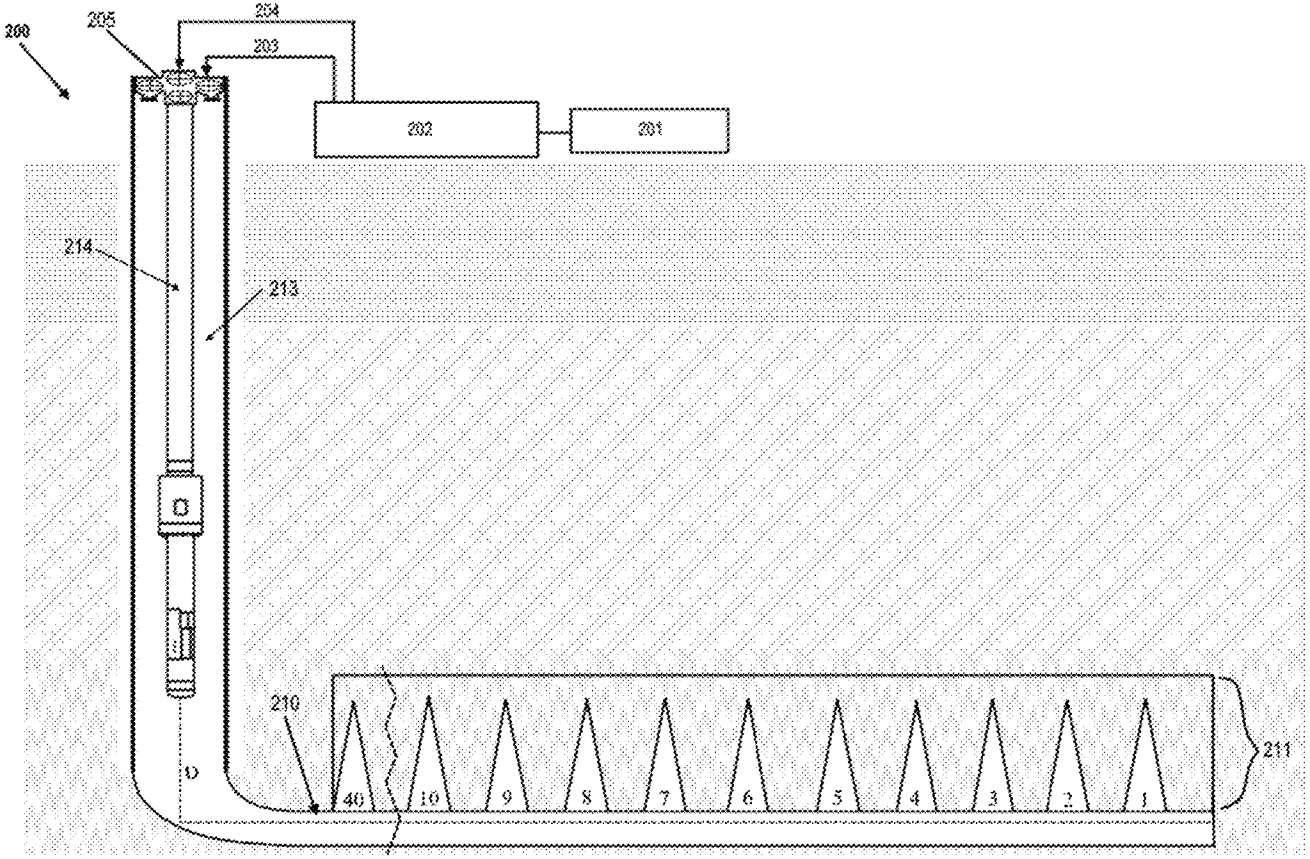
FIGS. 2A and 2B depict a wellbore, downhole assembly of the well, fracture stages, and remedial chemical stages, with FIG. 2B depicting the full frac stage sequence abbreviated in FIG. 2A.

The process is injected with no mechanical intervention into the existing well (109). Turning now to FIG. 2A, a schematic of the method embodiment in FIG. 1 as applied to a wellbore (200) via a pump truck (202) having chemical metering equipment (201) either on board or operatively connected to the pump truck (202). The fluid can either be injected (203) down the annular space (213) between the production tubing and the casing (annular injection) or injected (204) down the production tubing (214) (tubing injection), using the criteria previously discussed. The process is injected at a pressure that does not exceed the parting or fracture pressure of the well, which is based on the specific formation's fracture gradient and depth and/or the maximum allowable pressure determined by the wellhead (205) or downhole equipment assembly. Pressure is monitored with a surface and/or a bottom hole pressure gauge.

Figure 2B:
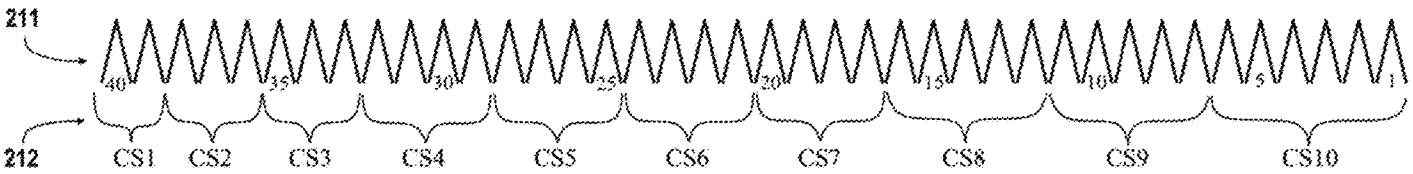

As charted in FIG. 1 and illustrated in FIG. 2A, in one embodiment of the remedial treatment, fluid is pumped down the annular space (213) of a wellbore (210) which for exemplary purposes comprises a total of 40 fracture stages (211). For clarity, only the first stage and last ten stages are depicted in FIG. 2A; the broken line represents the omissions. FIG. 2B is a simplified schematic depicted the alignment of the 40 fracture stages (211) of Example A with their respective chemical stages (212).

A first volume of treated water or remediation chemicals is injected (110) equal to the total volume of the wellbore from frac stage 40 to the end of the wellbore (210). Next, Chemical Stage 1 is injected (111) with a volume equal to the fracture pore volume of treated frac stages 40-39. Chemical Stage 1 may start a remediation with organic chemicals such as a solvent and/or dispersant; the volume will be between about 0.1% to 10% of the total volume of Chemical Stage 1. Next, the remaining volume of Chemical Stage 1 is injected and is composed of remediation chemicals. This portion of Chemical Stage 1 may encompass multiple sub-stages and is dependent on the damage mechanisms that are being remediated.

Figure 3:
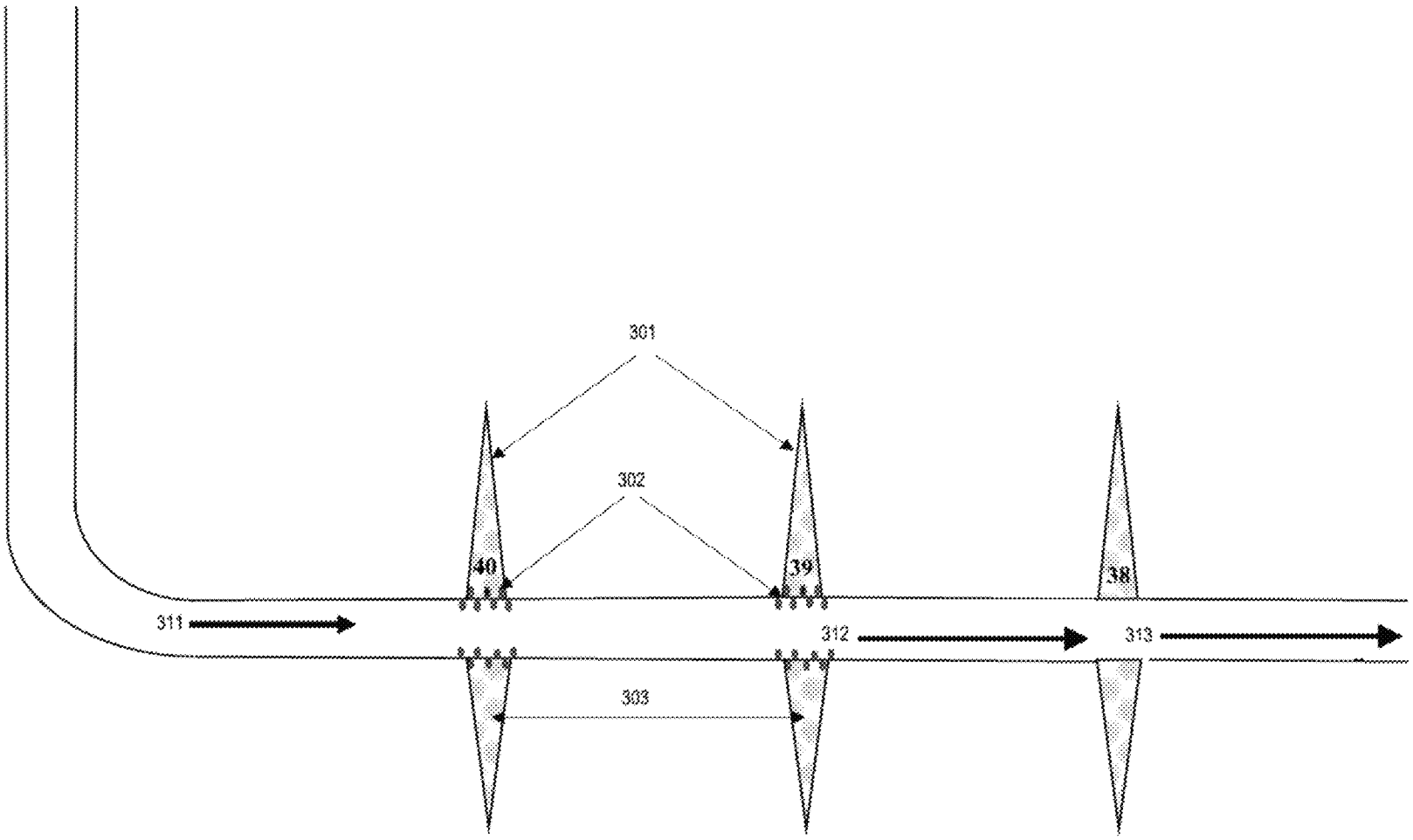
FIG. 3 depicts a downhole conceptualization of non-mechanical chemical stage placement and diversion.

FIG. 3 shows the detailed conceptualization of Chemical Stage 1 (311) entering the fracture stages 40-39. Following the injection of the full fluid volume of Chemical Stage 1, the chemical diverter (302) is deployed (111) which is intended to bridge off the perforations and/or fractures comprising a fracture pore volume (303) at the nearest end of the wellbore. FIG. 3 shows the bridging off the proximate perforations/fractures (301) for the target stages (211) as depicted by the "CS1" bracket in FIG. 2B. The diverter should be applied at a concentration between 0.5 to 15 lb per perforation. Following Chemical Stage 1 and diversion thereof, Chemical Stage 2 (312) is commenced (112), targeted at Treated Frac Stages 38-36 (again depicted aligned with the "CS2" bracket in FIG. 2B) with a total fluid volume equal to the fracture pore volume of Frac Stages 38-36. FIG. 3 illustrates diversion of Chemical Stage 2 (312) down a lateral wellbore to a next set of target fracture stages. Chemical Stage 2 may have the same chemical composition as Chemical Stage 1 or may vary depending on the well specifications and/or the assessed damage mechanisms. This process is continued (113) for the remaining Chemical Stages (313) entering the remaining Treated Frac Stages 35-1 as depicted in FIG. 2B.

Following the final Chemical Stage (Chemical Stage 10 in the depicted embodiment), a post flush stage is carried out (114) comprising injecting a volume equal to the annular space 213 plus the space from the end of the tubing (214) to the end of the wellbore (210), roughly demarcated in FIG. 2A by the broken line v. The post-flush stage (114) may be composed of treated water and/or remediation chemicals. The injection fluid is now stopped, and the well is shut-in. The well should be shut-in for at least 24 hours (115) before returning to production.

As shown in FIG. 1, in another embodiment of the remedial treatment (the tubular injection), fluid is pumped down the production tubing (214) of a well with a total of 40 fracture stages (211). The first volume of treated water or remediation chemicals equals the volume of the wellbore from frac stage 40 to the end of the wellbore (210). The application of the Chemical Stages is similar to the annular injection. Following Chemical Stage 10, the post flush volume similarly comprises a volume equal to the production tubing (214) plus the space from the end of the tubing to the end of the wellbore, again demarcated by the broken line u, where the post-flush stage may be composed of treated water and/or remediation chemicals.

This process can be used to protect an existing parent well from offset hydraulic fracturing operations in a new child well. By proceeding with annular injection or tubular injection as described above, the fracture pore volume is filled with remediation and well service treatment chemicals and through the non-mechanical diversion method, increases pressure to prevent fracture driven interference from the child well. In an embodiment, the total fluid volume may exceed the fracture pore volume and wellbore volume depending on the specific completion and production characteristics of the child and parent well. This process may be referred to as a "fracture protect," "pre-fill," "pre-load," and "defensive fracture process."

In the embodiment where this process is used for a "fracture protect" the total fluid volume may be designed as a multiple of the fracture pore volume from 1 to 50 times the fracture pore volume. The benefit of this process is the enhanced distribution of the fluids with the proposed diversion process will improve fluid distribution into all the propped fractures and surrounding matrix. This will maximize the build of poroelastic stresses in the matrix directly offsetting the fractures minimizing the risk of interference with the child well.

In the embodiment where this process is used for a "fracture protect" the use of the remediation and well service chemicals will minimize the damaging mechanism of water block that can be caused from plain water injection from the fracture protect or communication from the child well.

This process includes well remediation chemicals (107) that include but are not limited to solvents, dispersants, low tension surfactants, acids, acid inhibitors, oxidizers, enzyme breakers, and clay/fine stabilizers.

One type of well remediation chemicals are solvents and dispersants, designed to dissolve and disperse organic damage. The most likely organic damage is precipitation of the heaviest, polarizble fraction asphaltenes and/or linear alkanes of carbon numbers 14-40, characterized as paraffin waxes. This organic damage is most likely to happen in or near the wellbore, annulus, tubulars, and perforations. Solvents include but are not limited to alkyl hydrocarbons, aromatic hydrocarbons such as toluene or xylene, dialkyl ethers such as dihexyl ether or dioctyl ether, carboxylic acids, and terpenes such as d-limonene. Dispersants include but are not limited to anionic, cationic, amphoteric, or non-ionic surfactants. The solvent and dispersant maybe introduced as solution with a dispersant concentration of 0.5% to 50%. The solvent/dispersant solution may be introduced as a neat solution or in an emulsion with an aqueous fluid where the aqueous fluid concentration is about 10% to 90%.

In a preferred embodiment, the solvent solution will be introduced prior to the introduction of the low-tension surfactant solution to dissolve and disperse organic material resulting in a clear path for the low-tension surfactant solution to enter the fracture.

Another class of well remediation chemicals are low-tension surfactants that are designed to reduce the interfacial tension between the aqueous fluid and the crude oil and reduce the surface tension between the aqueous fluid and the natural gas. The low-tension surfactant should improve the relative permeability to crude oil and gas, thereby improving the flow rate of the crude oil and natural gas relative to the aqueous phase. The low-tension surfactants include but are not limited to anionic surfactants, cationic surfactants, non-ionic surfactants, or amphoteric surfactants. These solutions may include alcohols or solvents to improve stability and solubility. These solutions may also include nanoparticles such as nano-silica to improve the efficacy of the low-tension surfactant solution. The distribution of a low-tension surfactant into a maximum number of fractures with the use of this process will improve fracture conductivity through remediation of water phase trapping and reduction of multi-phase flow effects. This damage will primarily occur within the propped fractures, natural fractures, and at the fracture—matrix interface.

In a preferred embodiment, the low-tension surfactant solution will reduce the crude oil—aqueous interfacial tension from about 30-40 dynes/cm to about $10^{-1}$ to $10^{-2}$ dynes/cm. This reduction in interfacial tension should occur in both a freshwater brine with a total dissolved solids of less than 1,000 ppm and formation water brine with a total dissolved solids greater than 20,000 ppm. The low-tension surfactant solution will reduce the natural gas—aqueous solution surface tension by approximately 50% from about 50-70 dynes/cm to 25-35 dynes/cm. This reduction in surface tension should occur in both a freshwater brine with a total dissolved solids of less than 1,000 ppm and formation water brine with a total dissolved solids greater than 20,000 ppm.

Example results of interfacial testing and surface testing results are shown below in Table 2. The baseline interfacial tension between the fresh water and crude oil was about 32 dynes/cm and the baseline surface tension between the fresh water and gas was about 62 dynes/cm. After application of surfactant the interfacial and surface tension with brine—crude oil was reduced from baseline to approximately the same level.

TABLE 2

| Results of tension testing between freshwater/brine and crude oil | | | |
|---|---|---|---|
| Interfacial Tension (dynes/cm) | | Surface Tension (dynes/cm) | |
| Low-tension surfactant in fresh water (TDS 600 ppm) | Low-tension surfactant in brine (TDS = 35,00 ppm) | Low-tension surfactant in fresh water (TDS = 600 ppm) | Low-tension surfactant in brine (TDS = 35,00 ppm) |
| 0.08 | 0.06 | 28.3 | 29.1 |

A flow column test is used to measure the improvement of the flow rate of crude oil in proppant or sand, under gravity flow, relative to brine using low tension surfactant solution. The flow column is packed with proppant and then saturated with an aqueous solution. Crude oil is then introduced into the proppant pack and the flow rate is measured. The low-tension surfactant should improve the flow rate of crude oil by at least 5-10 times as compared to brine alone. Table 3 shows an exemplar improvement in flow rate of crude oil by introduction of low-tension surfactant.

TABLE 3

| Results of flow rate testing utilizing low-tension surfactants | |
|---|---|
| Crude oil flow rate-brine saturation (ml/min) | Crude Oil flow rate-low tension surfactant in brine (ml/min) |
| 0.2 | 4.5 |

In this preferred embodiment the low-tension surfactant should be dosed at a concentration of 100 to 1,000 ppm and can be diluted in fresh or produced brine. The volume of low-tension surfactant should compose the majority of volume injected during the process and should be equal to about the volume of the fracture pore volume calculated for each fracture stage.

Another class of well remediation chemicals are aqueous acids for remediation of inorganic deposition. Inorganic deposition, in the form of scale, will most likely occur in or near the wellbore, annulus space, tubing, or perforations. Acid may be organic or inorganic, or comprise salts and esters thereof. Acids may include but are not limited to hydrochloric acid, methanesulfonic acids, formic acid, acetic acid, and hydrofluoric acid. Acid inhibitors may be used to delay acid reaction.

In a preferred embodiment, the acid is injected during the first step of the process where the acid volume is equal to a percentage of the annulus plus wellbore volume (for annular injection) or to the tubing plus wellbore volume (tubular injection).

Another class of well remediation chemicals are oxidizers, which are applied when bacterial mass growth is detected and/or remediation of downhole damage is required from previous drilling and completion operations. The oxidizer may include, but are not limited to, persulfates, such as ammonia persulfate and sodium persulfate, peroxidies, such as hydrogen peroxide and peracetic acid, and hypochlorites, such as sodium hypochlorite, sodium chlorite chlorate or bromate.

In a preferred embodiment, when oxidizer is used for remediation of bacterial mass growth, the oxidizer is injected during the first step of the process where the acid volume is equal to the annulus plus wellbore volume (annular injection) or to the tubing plus wellbore volume (tubular injection).

In a preferred embodiment, when oxidizer is used for remediation of downhole damage from previous drilling and completion operations, the oxidizer, dosed at rate known in the art, should be included in 10-100% of the fluid injected during each chemical stage and is dependent on the specific damage being addressed and the location of the damage.

Another class of well remediation chemicals are enzyme breakers used for breaking down and cleaning up fracturing or well service fluids containing polymers such as guar, hydroxyalkylguar, carboxyalkylhydroxyguar, carboxyalkylhydroxyalkylguar, cellulose, hydroxyalkylcellulose, carboxyalkylhydroxyalkylcellulose, xanthum and the like. These enzyme breakers may include, but are not limited to, hemicellulase, particularly for lower temperature applications from 0° C. to 90° C.

This process includes chemical diversion (108) to distribute the fluids into the fractures without use of mechanical intervention. Chemical diverters are solids that temporarily block the path of least resistance and divert fluids to the next path of least resistance. In a preferred embodiment, the diverter will temporarily block the most conductive fracture and divert the remedial chemistry to the next highest conductive fracture. This process will maximize entry of the remedial chemistry into all the existing fractures connected to the wellbore without the need for mechanical intervention.

Chemical diverters may include, but are not limited to, rock salt, benzoic acid, naphthalene, wax beads, oil soluble resin or self-degradable diverters such as polyanhydrides, polyesters, polyorthoesters, polylactones, polyamides, and polyurethanes.

In a preferred embodiment, the self-degradable aliphatic polyester polylactic acid is used as the chemical diverter to achieve non-mechanical diversion. The self-degradable polylactic acid will degrade over time. This particulate diverter can be applied into subterranean reservoirs with temperatures between 130 to 350° F.

The aliphatic polyesters of the present invention may be prepared by substantially any of the conventionally known manufacturing methods, such as those disclosed in U.S. Pat. Nos. 6,323,307, 5,216,050, 4,387,769, 3,912,692 and 2,703,316, the relevant disclosures of which are incorporated herein by reference.

The design methodology for the non-mechanical intervention process using the preferred diverter polylactic acid requires knowledge of the number of fracture stages the diverter will be applied to and the number of perforations that exit the wellbore within those fracture stages. The diverter will be applied at a rate of about 0.5 to 15 pounds per perforation. The diverting chemical diverter can be formed into different particles sizes and shapes. The preferred polylactic acid embodiment encompasses a range in sizes with a range of 4 to less than 100 mesh with at least 10-55% of the particles have a size from 4/12 mesh.

The insoluble polylactic acid is mixed with brine to form a slurry that will be introduced into the wellbore through annular injection or tubular injection. The slurry concentration will range from about 0.1 to 3.5 pounds of diverter per gallon of water. The slurry concentration will depend on ratio of the orifice diameter or proppant pore throat size and the diameter of the largest diverter particulates.

It is preferred to increase the viscosity of the diverter slurry solution to improve transport capacity and diversion efficiency. Certain viscosity agents that are well known in the art such as guar, polyacrylamides, and/or crosslinking of these fluids can be used. Viscosity of the slurry can range from 5 to over 200+cP.

When a viscosity agent is used, an internal breaker may be used as well to ensure the viscosity can be reduced after a sufficient period of time. The internal breaker may be, but is not limited to, an oxidizer such as persulfates, such as ammonia persulfate and sodium persulfate, and peroxides such as hydrogen peroxide.

This non-mechanical intervention remedial process may also include typical well treatment service chemistry (107) that includes, but is not limited to, aqueous scale inhibitors, aqueous corrosion inhibitors, aqueous biocides, and aqueous oxygen scavengers.

Aqueous scale inhibitors attach themselves to wellbore and subterranean surfaces thereby inhibiting the formation of scale. The aqueous scale inhibitor may contain one or more materials including, but not limited to, but not limited to,-phosphonates, polyacrylates, and conventional chelants such as ethylenediamine tetraacetic acid, pentetic acid.

Aqueous corrosion inhibitors reduce corrosion rates of the downhole metal assembly by forming a film at the metal/solution interface. Suitable inorganic inhibitors can include, but are not limited to, alkali metal nitrites, nitrates, phosphates, silicates and benzoates. Suitable organic inhibitors can include, but are not limited to, hydrocarbyl amine and hydroxy-substituted hydrocarbyl amine neutralized acid compounds, such as neutralized phosphates and hydrocarbyl phosphate esters, neutralized fatty acids (e.g., those having 8 to about 22 carbon atoms), neutralized carboxylic acids (e.g., 4-(t-butyl)-benzoic acid and formic acid), neutralized naphthenic acids and neutralized hydrocarbyl sulfonates. Mixed salt esters of alkylated succinimides are also useful. Corrosion inhibitors can also include the alkanolamines such as ethanolamine, diethanolamine, triethanolamine and the corresponding propanolamines as well as morpholine, ethylenediamine, N,N-diethylethanolamine, alpha- and gamma-picoline, piperazine and isopropylaminoethanol.

Biocides control growth of common oilfield bacteria. Suitable biocides may include, but are not limited to, quaternary ammonium compounds, chlorine, hypochlorite solutions, tetrakis hydroxymethyl phosphonium sulfate, glutaraldehyde Oxygen scavengers reduce the propensity of oxygen to accelerate corrosion rates of downhole equipment. Suitable oxygen scavengers may include, but are not limited to, sulfites and bisulfites.

Clay stabilizers aid in preventing the swelling and migration of clays and fines. Suitable clay stabilizers may include, but are not limited to, potassium chloride, quaternary ammonium compounds, quaternized amine polymers, and organic amines.

While various embodiments usable within the scope of the present disclosure have been described with emphasis, it should be understood that the present invention may be practiced other than as specifically described herein.

Example A

A well located in Southern Texas in the subterranean Eagle Ford hydrocarbon formation had experienced a large increase in water production and decrease in oil and gas production due to downhole communication with an offset fracture stimulation. This negative communication resulted in a sustained decrease in hydrocarbon recovery with a 75% reduction in hydrocarbon estimated ultimate recovery.

The primary damage mechanisms from offset fracture communication were the large influx of water into the candidate well which increased capillary pressure in the matrix resulting in decreased hydrocarbon flow and increased water saturation in the existing proppant pack shifting the relative permeability curve and decreasing hydrocarbon flow. Two secondary damage mechanisms were identified: including paraffin and scale deposition. The crude oil had a wax content of 38% and the influx of cool water from the offset fracture stimulation and the pressure drop across the wellbore perforations resulted in paraffin deposition.

Scale tendency modeling using DSAT software from French Creek Software located in Pennsylvania indicated high likelihood of calcium carbonate scale in the wellbore at a forecasted rate of 90 lbs of calcite per 1000 bbl of water produced.

A series of laboratory tests were conducted to characterize the effectiveness of a series of surfactant formulations to reduce capillary pressure and improve hydrocarbon relative permeability. Of the various formulations tested, the two better performing surfactant formulas, SWA-95EX4 and 253-098-3, were further employed in this testing and were sourced from ChemEOR, Inc., located in Covina, Calif. Each surfactant formula was first blended at a ratio of 1.5:1 with 2-butoxyethanol. Each surfactant formula was diluted to 1 gallon per thousand (1 gpt) in either Houston, Tex. tap water (HTP), produced water (PW) from the candidate well, or a 1:1 ratio of HTP and PW. The PW had a total dissolved solids (TDS) of 74,551 ppm.

The first set of tests was measuring the reduction in interfacial tension (IFT) between the crude oil and the various waters using the different surfactant formulations. The IFT was measured on a Kruss spinning drop tensiometer. Table 4 shows the IFT for each crude oil and water composition at a dose rate of 1 gpt for each surfactant product. The IFT was reduced by an order of magnitude in all cases except the use of SWA-611 in HTP.

TABLE 4

IFT results

| | HTP | 1:1 HTP:PW | PW |
|---|---|---|---|
| No Surfactant | 30 | 30 | 30 |
| 253-098-3 | 0.25 | 0.07 | 0.12 |
| SWA-95EX4 | 0.18 | 0.03 | 0.04 |

Surface tension reduction measurements were completed using the above water compositions and surfactant formulations. Table 5 shows the surface tension measurements across the water compositions utilizing the different surfactant formulations.

TABLE 5

Surface tension

| | HTP | 1:1 HTP:PW | PW |
|---|---|---|---|
| No surfactant | 60 | 60 | 60 |
| 253-098-3 | 28.5 | 28.4 | 28.6 |
| SWA-95EX4 | 28.5 | 28.6 | 28.6 |

Flow column testing was run with the above surfactant products. Flow column testing measures the flow rate of crude oil through a proppant pack which is saturated with either water/brine or surfactant laden water/brine. The improved oil flow rate due to the surfactant laden fluid is a proxy for showing the improved relative permeability to oil in the proppant pack. The flow column described below is composed of a 50 mL glass column or burette with a stopcock attached at the bottom. It is first filled with 15 mL of 2% KCl solution and then packed with 30 grams of 60/100 mesh sieved sand. The pore volume of the sand pack is determined by measuring the increased fluid volume in the burette. The stopcock is turned on and fluid is drained until the meniscus is just above the height of the sand column. The testing fluid is then added up to the 40 mL mark and then the testing fluid is drained until the meniscus is just above the height of the sand column and allow it to soak for 30 minutes. Then add crude oil to the 30 mL mark. Open the stopcock and simultaneously begin timer. Record the time that one pore volume has been drained. Calculate the flow rate (pore volume/time). In some embodiments of this test, multiple pore volumes of oil can be run through the sand pack and the efficacy of the product can be measured over multiple pore volume.

Figure 4:
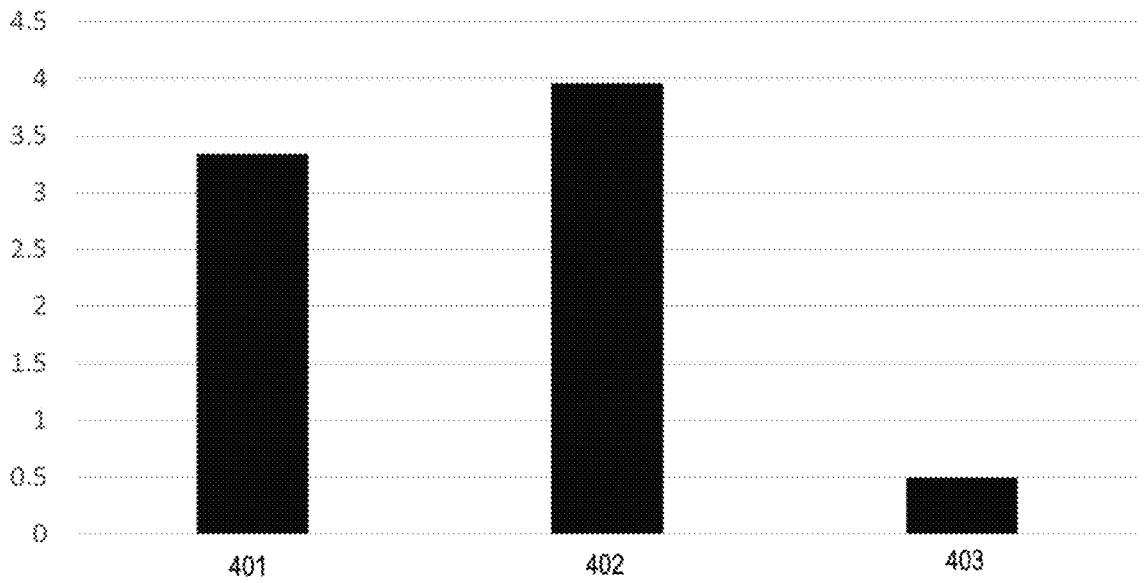
FIG. 4 is a chart depicting the results of a flow column test.

FIG. 4 shows the flow rate (ml/min) for the 235-098-3 (401) and SWA-95EX4 (402), each diluted to 1 gpt in HTP, versus HTP only (403). The 95EX-4 formulation performed the best with a crude oil flow rate of 3.96 mL/min compared to HTP only with a crude oil flow rate of 0.2 mL/min. The SWA95-EX4 product was chosen due to its superior performance in the flow column testing.

A chemistry package was developed to dissolve paraffin deposition composed of 95 vol % xylene and 5 vol % dodecyl benzene sulfonic acid. A synthetic acid Oil Safe AR (Heartland Energy Group LTD San Antonio, Tex.) capable of dissolving of 216 kg/m$^3$ of $CaCO_3$ was sourced for dissolution of calcium carbonate. A bis(hexamethlene)triamine penta(methlenephosphonic acid) sodium salt (BHMT) scale inhibitor was chosen at a dilution rate of 0.25 gpt.

Figure 5:
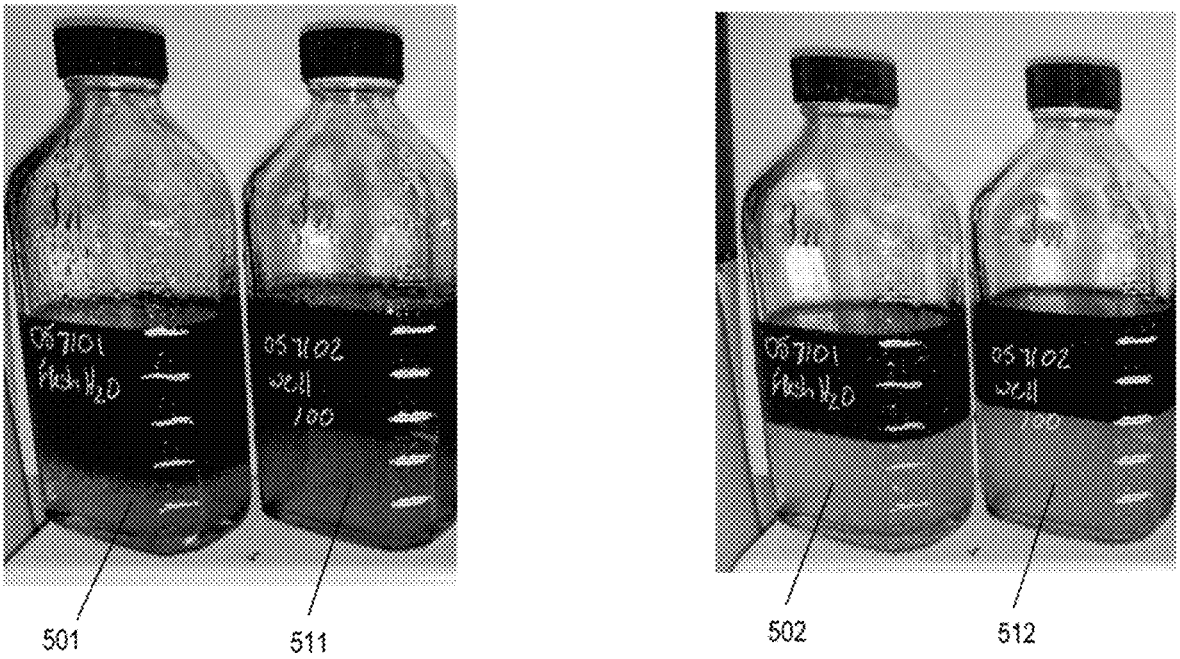
FIG. 5 is a photograph of an emulsion test.

Emulsion testing utilizing the aforementioned "chemistry package" was conducted with the various water compositions and crude oil to ensure no emulsions were formed. A 1:1 ratio of "chemistry package" laden water and crude oil was mixed and separation time was measured at 80° C. The 1:1 ratio fluid was first placed in a water bath at 80° C. for 10 minutes then removed and manually shaken for 2 minutes. The samples were then returned to the water bath and are visually monitored at 1 minute, 5 minutes, 10 minutes, 30 minutes, and 60 minutes or until full separation occurs. The water was dosed with 1 gpt SWA-95EX4, 2500 ppmv solvent, 500 ppmv Oil Safe AR, 0.25 gpt BHMT. FIG. 5 shows the pictures of the separation in HPT (501, 511) and PW (502, 512) before and after 10 minutes, respectively. Full separation was obtained within 10 minutes.

Figure 6:
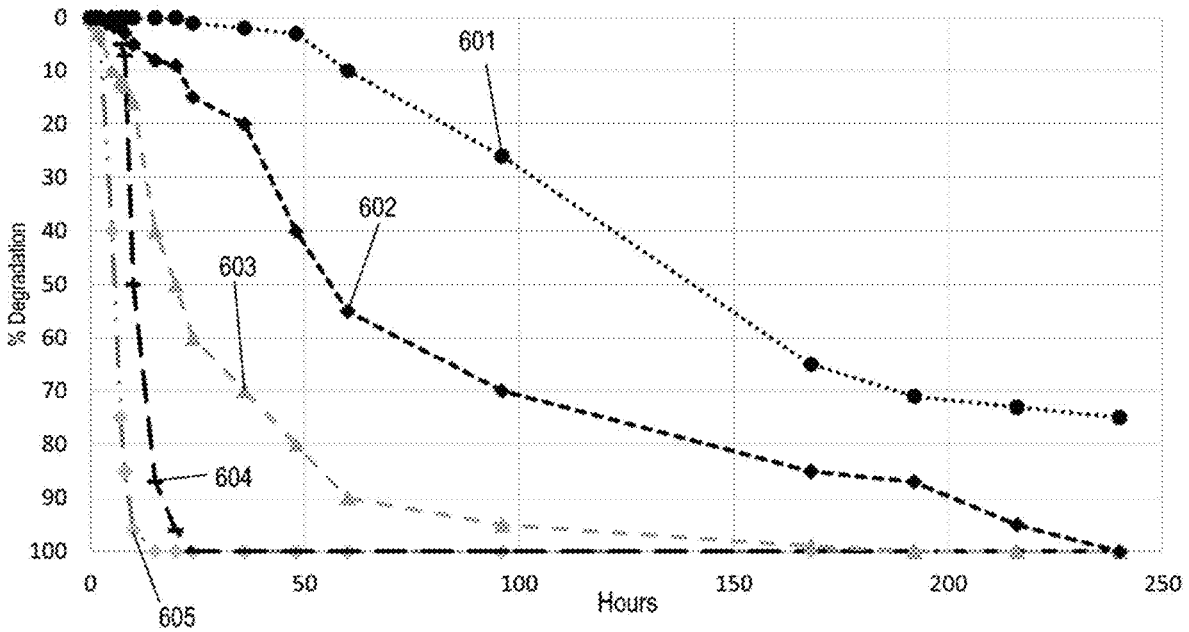
FIG. 6 is a chart showing the degradation of PLA diverter at various temperatures.

A biodegradable polylactic acid (PLA) particulate diverter was chosen for this application. FIG. 6 shows the degradation curves (expressed as percent as a function of hours) of PLA at temperatures of 176° F. (601), 194° F. (602), 220° F. (603), 230° F. (604), and 245° F. (605). The bottomhole temperature of this well was 204° F. indicating the particles will reach 50% degradation in approximately 50 hours. The target well used a proppant size of 40/70 at the end of each fracture stage. However, other particle sizes can be used as desired. Practical diversion design uses a maximum particles size that has a median diameter 6 times that of the proppant. Therefore, the maximum median PLA particle design is 10/12 mesh (2000/1680 microns). The diverter should have a range of particle sizes to achieve the jamming and plugging mechanism required for diversion. Table 6 shows the particle size distribution for the diverter used in this application.

TABLE 6

Diverter Particle Size Distribution

| Mesh | 8/12 | 8/20 | 14/40 | 40/70 | 70/140 |
|---|---|---|---|---|---|
| % | 15 | 15 | 15 | 15 | 40 |

It is critical in pumping diverters or slurry pumping that a minimum velocity is achieved to prevent particle settling. This concept is known as the limit deposit velocity (LDV). Two empirical slurry models (Oroskar & Turian, 1980 and Turian et al, 1987) were used to calculate the LDV for diverters in this rigless remediation application. It was determined the average LDV for an 8-mesh particle is 0.92 m/s or approximately 4 barrels per minute (BPM) in 5.5-inch casing. If the viscosity of the carrying fluid could be increased to 10 cP then, then LDV is reduced to an average of 0.81 m/s or approximately 3.25 bpm. Therefore, it was determined using a guar linear gel with a density of 4 lb/gal dosed at a rate of 24 lb per 1000 gallons of treatment fluid a viscosity of 10 cP could be achieved. To ensure no damage from the linear gel, an encapsulated delayed ammonium persulfate breaker was included at a dose rate of 0.25 lb per lb of guar linear gel.

The target well had a total vertical depth of 7,389' and a perforated interval of 9,966'. The well was completed with a plug and perforation method and has a total of 40 fracture stages, 126 perforation clusters, and 756 total perforations. The total amount of proppant placed was 20.02 MM pounds in 419,553 barrels of water. The well was on artificial lift with rod lift with a tubing anchor set at 6,864'.

Utilizing the fracture pore volume calculation with the 20.02 MM pounds of proppant, a fracture pore volume of 9,250 bbl was calculated. Based on the original 40 fracture stimulation stages, 10 chemistry stages were designed and the stage volumes and intended treated fracture stages are shown in Table 7. (The stages of Example A were used for the exemplar depiction in FIG. 2B) The treatment is designed to inject down the annular space between the production tubing and casing. This requires no mechanical intervention or changes to the well setup.

TABLE 7

Stage Volume Design

| Chem Stage # | Frac Stage Start | Frac Stage End | Total Frac Stages | Fluid Volume (bbl) |
|---|---|---|---|---|
| 1 | 1 | 2 | 2 | 463 |
| 2 | 3 | 5 | 3 | 694 |
| 3 | 6 | 8 | 3 | 694 |
| 4 | 9 | 12 | 4 | 925 |
| 5 | 13 | 16 | 4 | 925 |
| 6 | 17 | 20 | 4 | 925 |
| 7 | 21 | 24 | 4 | 925 |
| 8 | 25 | 29 | 5 | 1156 |
| 9 | 30 | 34 | 5 | 1156 |
| 10 | 35 | 40 | 6 | 1388 |

A 300-gallon solvent and 500-gallon synthetic acid pre-flush is designed to remediate any paraffin and scale deposition in the wellbore, respectively. This is followed by a 197 bbl pre-flush containing the SWA 95EX-4 at 1 gpt and scale inhibitor at 0.25 gpt which is a sufficient volume to fill up from end of wellbore to the heel perforation. Stage 1 is then commenced with a solvent pre-flush designed at 33 gallons per fracture stimulation stage followed by the remaining stage volume dosed with 1 gpt SWA 95EX-4 and scale inhibitor at 0.25 gpt.

The diverter is designed at a rate of 2 pounds per perforation and is deployed with the linear gel and encapsulated breaker. The diversion package is deployed at the end of each stage and is injected at a concentration of 0.2 lbs of diverter per gallon of water. Each diverter package injection is followed by a 5 bbl pad injection which is composed of a 4 lb/gal linear gel dosed a rate of 30 lb/1000 gal of water and encapsulated breaker dosed at 0.25 lb/lb linear gel. The treatment is ended with a 326 bbl post-flush with 1 gpt SWA 95EX-4 and scale inhibitor at 0.25 gpt to flush chemistry to the toe perforations.

Figure 7:
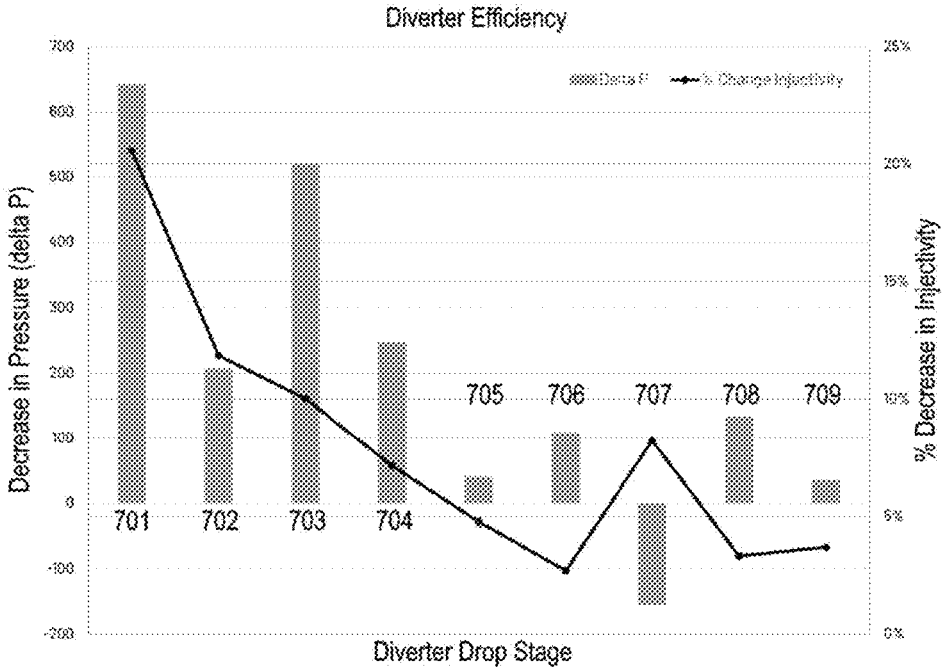
FIG. 7 is a chart comparing the change in pressure and percent change in injectivity for each stage of the treatment described in Example A.

FIG. 7 shows the decrease in pressure (bars) and percent change in injectivity (line) each stage (701-709). Injectivity is defined at rate (bpm) divided by pressure (psi). Injectivity is useful as maximum allowable injection pressure (MAIP) was reached during the treatment, so the injection rate was reduced to stay below the MAIP. The total change in pressure was 3,005 psi and injectivity reduction of 77%. This demonstrates the efficacy of the diversion in a rigless, remedial application.

Figure 8:
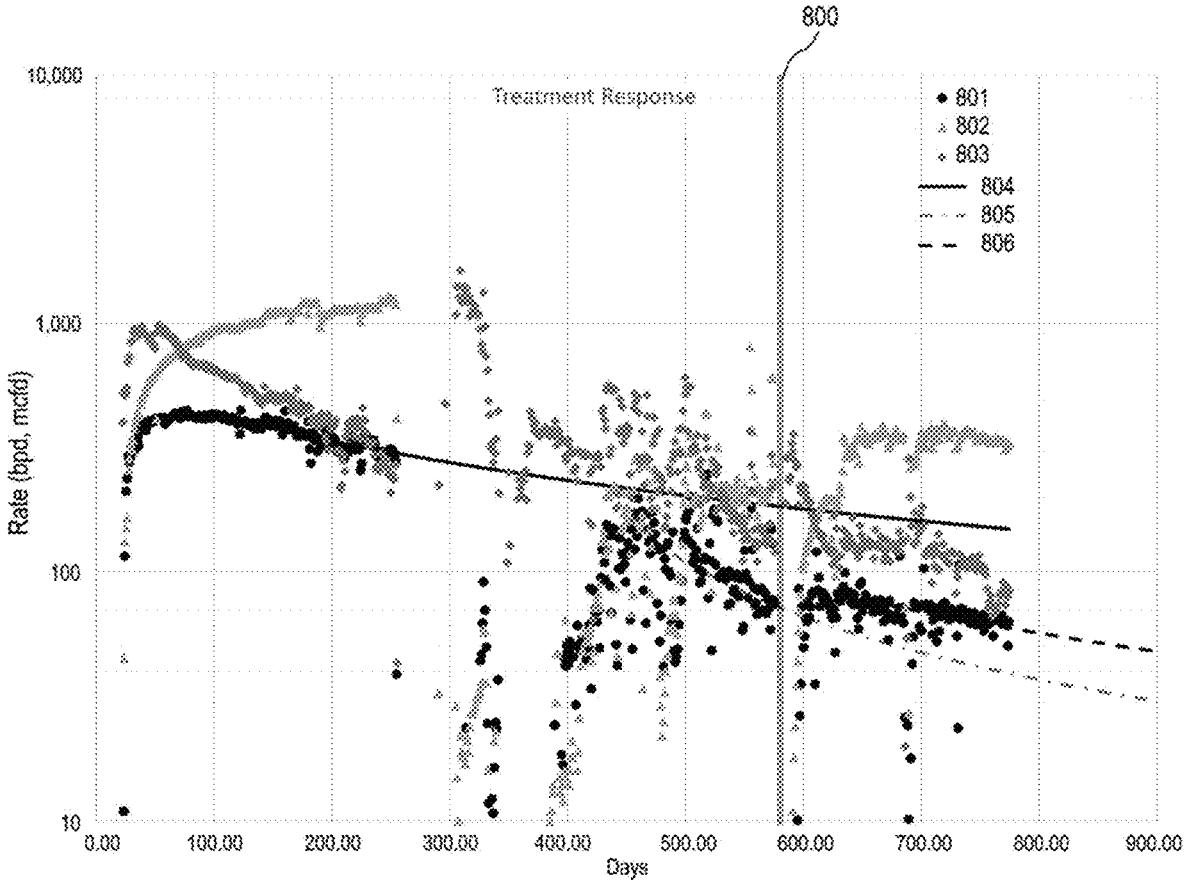
FIG. 8 is a chart depicting the hydrocarbon response from the treatment described in Example A.

FIG. 8 shows the hydrocarbon response from the rigless remedial treatment (800) over the course of the following days, including scatter-plots of oil production (801), gas production (802) and water production (803). Lines are plotting showing the pre-frac hit decline (804), post-frac hit decline (805) and post-treatment decline (806). Post-treatment the well was shut-in for 48 hours and then returned to production. Gas production returned within 7 days and oil production in 9 days post-treatment. The well is making approximately 60% incremental oil production and 120% incremental gas production, with a considerably shallower decline. The forecasted incremental barrel of oil equivalent EUR is 30% and has returned highly profitable returns.

Example B

A well located in Southern Texas in the subterranean Eagle Ford hydrocarbon formation was experiencing poor hydrocarbon recovery relative to type curve forecasts. A proposed contributing mechanism to the poor hydrocarbon recovery is unfavorable reservoir wettability and poor contribution of hydrocarbon flow from all stimulated perforations. A secondary mechanism was paraffin deposition particularly at the perforations and the wellbore. Finally, scale tendency modeling referenced above showed calcite potential of 56 lbs/1000 barrels of produced water.

The same chemistry and application design process was followed as detailed in Example A and similar results were found. To further quantify wettability alteration, a contact angle test was run utilizing Dataphysics Contact Angle System OTA instrument. A marble chip is saturated in oil at 80° C. for 24 hours to establish a mixed to oil wet surface. The chip is then submerged in oil within the contact angle system and an oil droplet is formed on the surface of the chip. Utilizing a syringe, 2 microns of HTP is deposited onto the oil drop and utilizing the high-speed camera the contact angle is measured. The same procedure is repeated with 2 microns of HTP with 1 gpt of SWA-95EX4 and contact angle is measured. Table 8 shows the results of the contact angle testing. The SWA-95EX4 product reduced the surface from a mixed to oil wet state to a highly water wet state.

TABLE 8

Contact angle results

| Fluid | Contact Angle (°) |
|---|---|
| HTP | 72.4 |
| HTP + SWA-95EX4 @ 1 gpt | 9.0 |

The target well described in Example B has a total vertical depth of 7,332' and a perforated interval of 11,999'. The well was completed with a plug and perforation completion method with a total 47 stages, 470 clusters, and a total of 1,410 perforations. 23.7 MM lbs of proppant was pumped with 543,831 bbl of completion fluid. The well is currently on plunger lift with gas lift assist with a packer set at 6,897'.

Utilizing the fracture pore volume calculation with the 23.7 MM pounds of proppant, a fracture pore volume of 10,950 bbl was calculated. Based on the original 47 fracture stimulation stages, 12 chemistry stages were designed and the stage volumes and intended treated fracture stages are shown in Table 9.

TABLE 9

Stage Volume Design

| Chem Stage # | Frac Stage Start | Frac Stage End | Total Frac Stages | Fluid Volume (bbl) |
|---|---|---|---|---|
| 1 | 1 | 2 | 2 | 466 |
| 2 | 3 | 4 | 2 | 466 |
| 3 | 5 | 7 | 3 | 699 |
| 4 | 8 | 10 | 3 | 699 |
| 5 | 11 | 14 | 4 | 932 |
| 6 | 15 | 18 | 4 | 932 |
| 7 | 19 | 22 | 4 | 932 |
| 8 | 23 | 26 | 4 | 932 |
| 9 | 27 | 31 | 5 | 1165 |
| 10 | 32 | 36 | 5 | 1165 |
| 11 | 37 | 41 | 5 | 1165 |
| 12 | 42 | 47 | 6 | 1398 |

The treatment is designed to inject down the tubing at 8 bpm requiring no mechanical intervention. The tubing has an outer diameter of 2.375" and an inner diameter of 1.995". The estimated friction pressure during fluid injection at a rate of 8 bpm was 4,269 psi. Therefore, it was determined that a 0.5 gpt of Chemplex 953, an anionic polymeric based friction reducer sourced from Solvay S.A. located in Brussels, Belgium, was required which would reduce friction pressure to 1,612 psi at an injection of 8 bpm.

Laboratory results were found to be similar to those described in Example A and based on further laboratory results described in Example A, similar design parameters and chemical dose rates were used for this application.

The total treatment volume was 11,877 bbl which included a 257 bbl pre-flush, 10,950 bbl fracture pore volume, 322 bbl diverter fluid, 55 bbl pad, and a 293 bbl post-flush.

Figure 9:
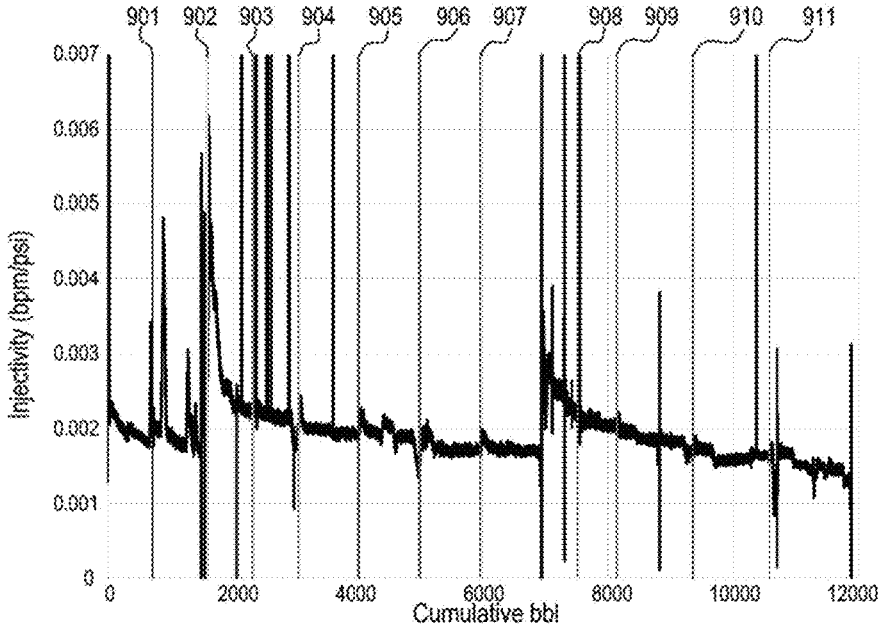
FIG. 9 is a chart comparing injectivity and cumulative fluid during the stages of the treatment described in Example B.

FIG. 9 shows the injectivity (bpm/psi) versus cumulative fluid injection plot for the treatment, with the 11 diverter drops demarcated by vertical lines (901-911, respectively). Due to some operational issues during the start of the treatment, injectivity behavior (900) is erratic. Following diverter drop 2, operational issues were resolved and it can be seen injectivity was consistently reduced following each diverter drop.

Figure 10:
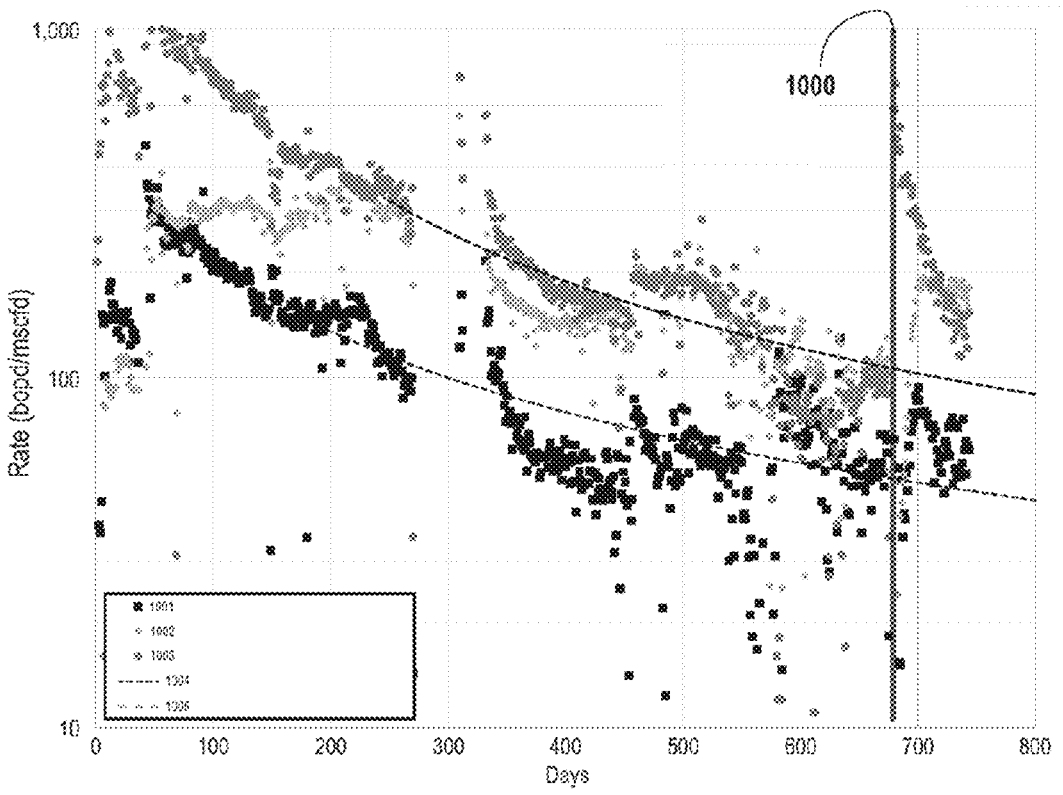
FIG. 10 is a chart showing the production returns of the intervention described in Example B.

FIG. 10 shows the hydrocarbon production response from the treatment (1000). Oil production (1001), gas production (1002), and water production (1003) all responded favorably compared to pre-treatment decline curves for oil (1004) and gas (1005). The incremental oil and gas production was 32% and 80%, respectively. Further data is required to forecast incremental EUR, but the economics of the treatment are highly favorable with rapid payback.

Example C

Figure 11:
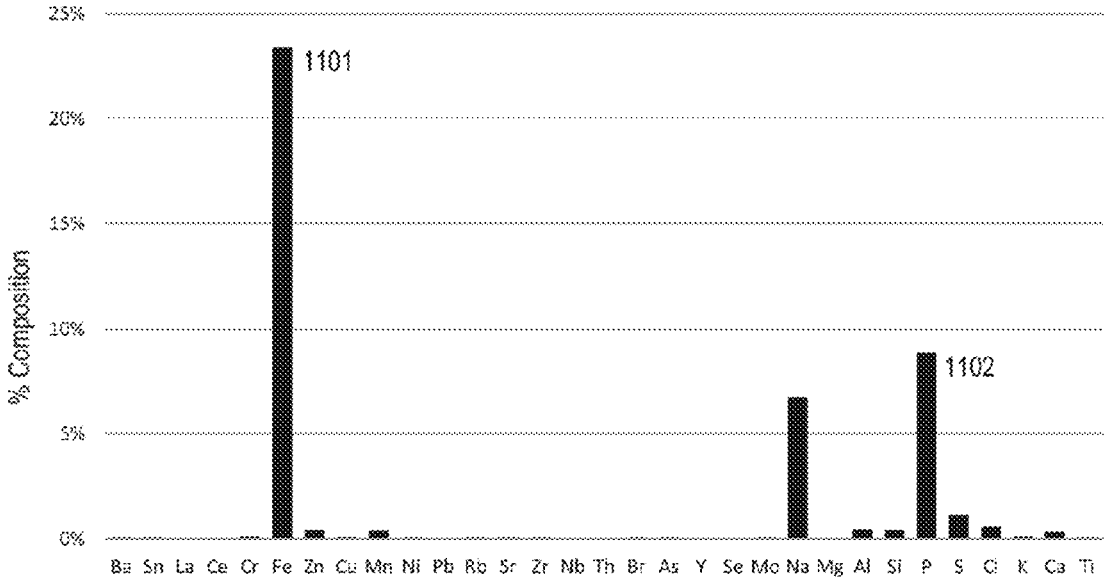
FIG. 11 is an X-ray fluorescence (XRF) analysis of solids from the well in Example C.

A hydrocarbon producing well located in the Powder River Basin in Wyoming, USA was rapidly losing total fluid production after the initial fracture stimulation completion. A black, solid substance was recovered from the well and X-ray fluorescence (XRF) analysis was run utilizing a ThermoFisher Scientific Quant X. FIG. 11 shows the XRF results. The sample was primarily composed of 23.4% iron (1101), 8.8% phosphorous (1102), and 30.6% of organic material. It was found that a 2.2 gpt of FightR EC-1, a high concentration anionic polyacrylamide friction reducer from Halliburton located in Houston, Tex. USA, was used on the initial fracture stimulation treatment. It was also found that 1,600 gallons of 15% hydrochloric acid (HCL) and 2,200 gallons of 7.5% of HCl was used. The target subterranean hydrocarbon formation was suspected to have an appreciable amount of iron bearing minerals. These minerals can be dissolved from the HCl releasing ferrous iron. The dissolved oxygen in the fracture stimulation fluid will oxidize ferrous to ferric iron. The ferric iron is then available to crosslink the friction reducer and produce the black solid material which precipitated from the fluid and resulted in the fluid productivity loss. A secondary mechanism is unfavorable wettability and water block damage.

Laboratory testing was performed to assess the dissolution of solid material and to lower the interfacial tension between the treatment water and formation crude oil. Numerous chemical formulations were tested and the most promising product was a surfactant based formulation FinX40 sourced from Muby Chemicals located in Gujarat, India combined with a solvent composed of 95 vol % xylene and 5 vol % dodecyl benzene sulfonic acid. The combined product is referred to as FinX40±solvent. The dissolution test procedure required weighing 0.25 grains of the solid material, placing the solid material into glass jars filled with 100 mL desired chemistry, aging the solution at 80° C. for 24 hours, filtering any remaining solid material utilizing a 20-micron filter, and weighing the resultant solid material. Table 10 shows the solid material dissolution results using dose rates of FinX40+ solvent of 4 gpt and 8 gpt. Both dose rates showed high and similar dissolution rates of the solid material and therefore the lower 4 gpt dose rate was utilized.

TABLE 10

Solid material dissolution testing

| Product | Dose Rate (gpt) | Start weight (gm) | End weight (gm) | Fluid volume (mL) | % weight loss |
|---|---|---|---|---|---|
| FinX40 + solvent | 4 | 0.25 | 0.013 | 100 | 95% |
| FinX40 + solvent | 8 | 0.25 | 0.027 | 100 | 89% |

The interfacial tension was tested utilizing the FinX40 product at 4 gpt in HTP and the formation crude oil. The test was performed on a Kruss spinning drop tensiometer. Table 11 shows the IFT results of the HTP baseline and utilizing the 4 gpt FinX40 solution. An IFT of 0.13 dynes/cm met the goal of less than 1 dynes/cm and was determined sufficient to alter wettability and improve hydrocarbon production.

TABLE 11

IFT results

| Fluid | IFT (dynes/cm) @ 80° C. |
|---|---|
| HTP + crude oil | 18.3 |
| HTP with 4 gpt FinX40 + crude oil | 0.13 |

The target well described in Example C has a total vertical depth of 7,871' and a horizontal perforated interval of 7,347'. The well was completed with 4.12 MM lbs of proppant and 60,658 bbl of completion fluid with a plug and perforation method. The well had a total of 20 stages, 100 perforation clusters, and 600 perforations. The well had tubing with 2.875" outer diameter and inner diameter 2.441" and a total length of 7,756'.

Based on the 4.12 MM lbs of proppant, a fracture pore volume of 2,200 bbls was calculated. Based on the 20 fractures, 8 chemical stages were designed. Table 12 provides the chemical stage volume design and intended treated fracture stages.

TABLE 11

Stage Volume Design
Stage Volume Design

| Chem Stage # | Frac Stage Start | Frac Stage End | Total Frac Stages | Fluid Volume (bbl) |
|---|---|---|---|---|
| 1 | 1 | 1 | 1 | 110 |
| 2 | 2 | 2 | 1 | 110 |
| 3 | 3 | 4 | 2 | 220 |
| 4 | 5 | 6 | 2 | 220 |
| 5 | 7 | 9 | 3 | 330 |
| 6 | 10 | 12 | 3 | 330 |
| 7 | 13 | 16 | 4 | 440 |
| 8 | 17 | 20 | 4 | 440 |

The total treatment volume design was 2,731 bbl consisting of 171 bbl pre-flush, 239 bbl post-flush, 2,200 bbl fracture pore volume, and 121 bbl of diversion fluid and pads.

The treatment began with a 50-gal flush of the solvent followed by 169 bbl of fresh water dosed with 4 gpt of FinX40. Each stage starts with solvent designed at a dose rate of an average of 0.30 gal per targeted perforation. Following solvent injection, the stage fluid volume is injected with FinX40 dosed at 4 gpt.

Following each stage fluid volume, the diversion package is deployed. The diverter is designed at a rate of 2 pounds per perforation and is deployed with the linear gel and encapsulated breaker. The diversion package is deployed at the end of each stage and is injected at a concentration of 0.2 lbs of diverter per gallon of water. Each diverter package injection is followed by a 5 bbl pad injection which is composed of a 4 lb/gal linear gel dosed a rate of 30 lb/1000 gal of water and encapsulated breaker dosed at 0.25 lb/lb linear gel.

The same biodegradable PLA diverter was utilized for this well as shown in Example A. The well has a bottomhole temperature of 80° C. so it was determined from FIG. 3 that 50% degradation would occur after 53 hours. The well finished each fracture stage with a proppant size of 40/70 mesh, so the same PLA particle size distribution was used as shown in table 6.

Figure 12:
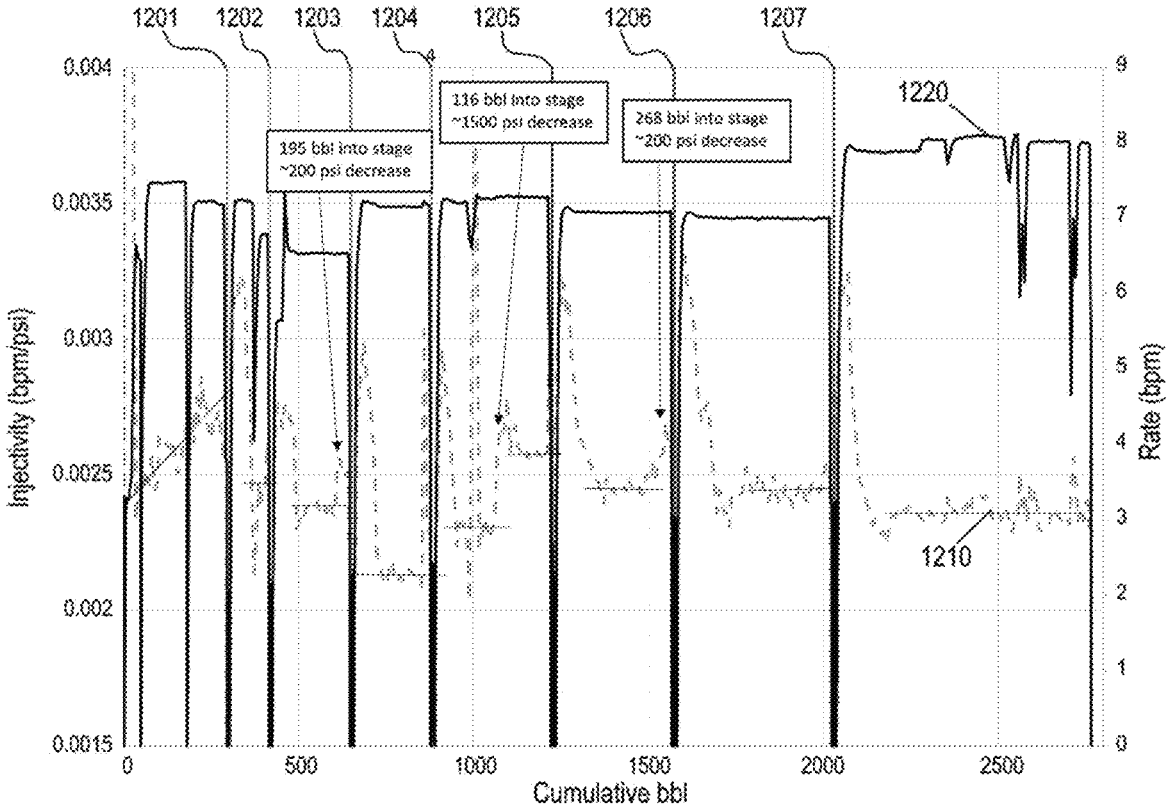
FIG. 12 is a chart showing the injectivity and flow rate responses to treatment from the well of Example C.

FIG. 12 shows the injectivity (1210) (bpm/psi) and injection rate (1220) (bpm) versus cumulative fluid injected over the course of the seven drops (1201-1207). Annotations are shown where abrupt injection pressure decreases or injectivity increases were observed. These changes were interpreted as dissolution and breakdown of downhole solids damage either within the wellbore or within the fracture pore volume. Outside of decreasing pressure due to solids dissolution, consistent injectivity declines were observed after most of the diversion drops. This indicates good fluid distribution along the wellbore and into the different fracture stages demonstrating the efficacy of the rigless approach.

Figure 13:
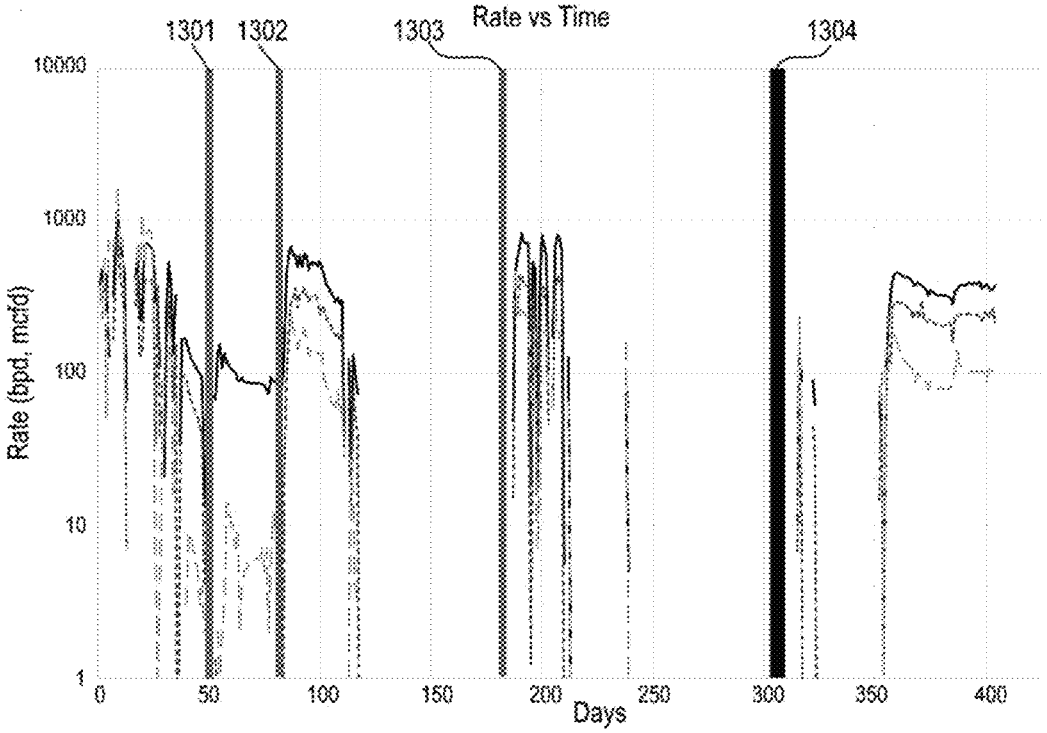
FIG. 13 is a chart showing production returns from the treatment of Example C.

FIG. 13 shows the hydrocarbon production response from the treatment (1304). It should be noted that previous unsuccessful attempts to remediate the solids damage (1301-1303) were conducted using small volumes of 20,000 ppm of citric acid and 1 gpt of WAW3003 from Baker Hughes located in Houston, Tex. USA. The volumes ranged from 100 to 200 bbls. The well was unable to produce fluid prior to the rigless remediation treatment. At that time of this writing, post-treatment the well has been making 350 to 400 barrels of oil per day and 200 to 300 thousand standard cubic feet per day of gas for more than 2.5 months.

The invention claimed is:

1. A method of non-mechanically intervening to remediate damage to a wellbore, the wellbore comprising production tubing and a plurality of fracture stages and extending through a formation, the method comprising:

(a) selecting, based on the damage remedial chemicals for treating the wellbore, the remedial chemicals comprising one or more of a solvent, a surfactant, an acid, an oxidizer, an enzyme breaker, a clay stabilizer, or a fine stabilizer;

(b) calculating a total treatment volume for treatment fluid, wherein the treatment fluid comprises the remedial chemicals, the total treatment volume comprising:

a fracture pore volume for each fracture stage of the plurality of fracture stages, each of the fracture stages comprising proppant, wherein:

the fracture pore volume is a function of properties of the proppant, the properties comprising mass, bulk density and proppant pack porosity; and a wellbore volume of the wellbore;

(c) determining, based on the plurality of fracture stages, a plurality of chemical stages, wherein each chemical stage of the plurality of chemical stages comprises a subset of fracture stages within the plurality of fracture stages;

(d) selecting a chemical stage within the plurality of chemical stages;

(e) calculating a volume of the selected chemical stage, wherein the volume of the selected chemical stage is the fracture pore volume of the subset of fracture stages;

(f) selecting, based on the subset of fracture stages, a chemical diverter;

(g) determining a diversion volume of the chemical diverter, wherein the diversion volume is based on the subset of fracture stages and a number of perforations that exit the wellbore within the subset of fracture stages;

(h) pumping a portion of the total treatment volume into the wellbore to the selected chemical stage, at an injection pressure, wherein:

the portion of the total treatment volume is equal or greater to the volume of the selected chemical stage; and wherein the injection pressure maintains the wellbore at a pressure that is less than a parting or fracture pressure of the formation; then (i) pumping the diversion volume comprising the chemical diverter into the wellbore to close off the subset of fracture stages; and (i) repeating steps (d)-(i) for each chemical stage of the plurality of chemical stages.

2. The method of claim 1, wherein the chemical diverter comprises a soluble or biodegradable particulate.

3. The method of claim 1, wherein step (c) comprises increasing the number of fracture stages in the subset of fracture stages per chemical stage as a function of decreasing conductivity of the fracture stages.

4. The method of claim 1, wherein the remedial chemicals comprise the solvent, and wherein the solvent comprises one or more of alkyl hydrocarbons, aromatic hydrocarbons, dialkyl ether, carboxylic acids, or terpenes.

5. The method of claim 1, wherein the remedial chemicals comprise the surfactant, and wherein the surfactant comprises one or more of an anionic, cationic, amphoteric, or non-ionic surfactant.

6. The method of claim 1, wherein the remedial chemicals comprise the acid, and wherein the acid comprises one or more of hydrochloric acid, methanesulfonic acid, formic acid, acetic acid, or hydrofluoric acid.

7. The method of claim 1, wherein the remedial chemicals comprise the oxidizer, and wherein the oxidizer comprises one or more of ammonium persulfate, sodium persulfate, hydrogen peroxide, peracetic acid, sodium hypochlorite, sodium chlorite, sodium chlorate, or sodium bromate.

8. The method of claim 1, wherein the remedial chemicals comprise the enzyme breaker, and wherein the enzyme breaker comprises hemicellulase.

9. The method of claim 1, further comprising the step of pumping a pre-flush treatment stage prior to step (h), wherein the pre-flush treatment stage comprises a total volume of the wellbore from an onset of the fracture stages to an end of the wellbore.

10. The method of claim 1, further comprising pumping a post-flush stage subsequent to step (i), wherein: the post-flush stage comprises an inner volume of the production tubing; and the post-flush stage comprises one or more of treated water or the remedial chemicals.

11. The method of claim 1, further comprising pumping a post-flush stage subsequent to step (i), wherein: the post-flush stage comprises a volume of annular space between an outer diameter of the production tubing and an inner diameter of the wellbore and a volume from an end of the production tubing to an end of the wellbore; and the post-flush stage comprises one or more of treated water or the remedial chemicals.

12. The method of claim 1, wherein selecting the chemical diverter in step (f) is further based on a reservoir temperature of the wellbore.

13. The method of claim 1, wherein: the method further comprises determining that the wellbore comprises an artificial lift with pump and tubing anchor; and the pumping in step (h) comprises: pumping, based on the wellbore comprising the artificial lift, the portion of the total treatment volume into an annular space of the wellbore at the injection pressure.

14. The method of claim 1, wherein: the method further comprises determining that the wellbore comprises an artificial lift with pump and tubing anchor; and the pumping in step (h) comprises: pumping, based on the wellbore comprising the artificial lift, the portion of the total treatment volume into the production tubing of the wellbore at the injection pressure.

15. The method of claim 1, wherein: the method further comprises determining that the wellbore lacks an artificial lift with pump; and the pumping in step (h) comprises pumping the first portion of the total treatment volume into a production casing of the wellbore at the injection pressure.

16. The method of claim 1, wherein the diversion volume comprises the chemical diverter at a concentration of 0.5 to 15 pounds per perforation of the number of perforations that exit the wellbore within the subset of fracture stages.

* * * * *